US006834463B2

(12) United States Patent
Fukumoto et al.

(10) Patent No.: US 6,834,463 B2
(45) Date of Patent: Dec. 28, 2004

(54) OPENING AND CLOSING MECHANISM FOR VEHICLE OPENING

(75) Inventors: Ryoichi Fukumoto, Nagoya (JP); Nobuhiko Takeda, Aichi-ken (JP); Yasuhisa Inaba, Handa (JP); Hiroji Ikeda, Nagoya (JP); Manabu Kuyama, Nagoya (JP); Kouji Tanauchi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/255,627

(22) Filed: Sep. 27, 2002

(65) Prior Publication Data

US 2003/0079413 A1 May 1, 2003

(30) Foreign Application Priority Data

Sep. 28, 2001 (JP) ..... 2001-300062
Sep. 28, 2001 (JP) ..... 2001-300063
Sep. 28, 2001 (JP) ..... 2001-300064

(51) Int. Cl.[7] ..... E05F 11/24
(52) U.S. Cl. ..... 49/341; 296/56; 296/146.8
(58) Field of Search ..... 49/339, 340, 341, 49/344; 296/56, 146 B, 146.11

(56) References Cited

U.S. PATENT DOCUMENTS 2,819,065 A * 1/1958 Jones ..... 49/340
3,332,169 A * 7/1967 Lohr et al. ..... 49/340
3,716,945 A * 2/1973 Cooper et al. ..... 49/340
6,142,551 A 11/2000 Ciavaglia et al.
6,283,535 B1 * 9/2001 Yuge ..... 296/146.8
6,382,706 B2 * 5/2002 Yuge et al. ..... 296/146.8
6,401,392 B1 * 6/2002 Yuge ..... 49/340
6,453,614 B1 * 9/2002 Rogers, Jr. et al. ..... 49/340
6,513,859 B2 * 2/2003 Yuge ..... 296/146.8
2003/0089041 A1 * 5/2003 Daniels et al. ..... 49/341

FOREIGN PATENT DOCUMENTS

DE 1584116 3/1969
GB 1077146 10/1964
JP 2000-335245 A 12/2000

* cited by examiner

*Primary Examiner*—Jerry Redman
(74) *Attorney, Agent, or Firm*—Burns, Doane, Swecker & Mathis, L.L.P.

(57) ABSTRACT

An opening and closing mechanism for a cover of a vehicle opening which transmits the actuation force securely and effectively. The opening and closing mechanism for cover of a vehicle opening includes a crank gear being rotatable about a crank axis center for opening and closing the opening and closing mechanism for the cover for a vehicle opening, a slider reciprocating along a guide member, and a cover operation member one end of which is pivoted on a crank pin of the crank gear, the other end of which includes a crank arm pivoted on a slider pin of the slider, and provided between the slider and the cover for a vehicle opening and being swingably relative to the slider for cooperating the slider and the cover of a vehicle opening.

22 Claims, 10 Drawing Sheets

OPENING AND CLOSING MECHANISM FOR VEHICLE OPENING

This application is based on and claims priority under 35 U.S.C. § 119 with respect to Japanese Application No. 2001-300062 filed on Sep. 28, 2001, Japanese Application No. 2001-300063 filed on Sep. 28, 2001, and Japanese Application No. 2001-300064 filed on Sep. 28, 2001, the entire content of which are incorporated herein by reference.

FILED OF THE INVENTION

The present invention relates to an opening and closing mechanism. More particularly, the present invention pertains to an opening and closing mechanism for opening and closing a cover for vehicle such as a back door of a one-box car and a sunroof for a vehicle.

BACKGROUND OF THE INVENTION

A known opening and closing mechanism for vehicle opening is disclosed in Japanese Patent Application Laid-Open No. 2000-335245. According to the known opening and closing mechanism for vehicle opening, actuation force from an electric motor is transmitted to a slider member via a worm fixed to the electric motor, a worm wheel engaged with the worm, and a pinion gear formed coaxially with the worm wheel.

The approximately rectangular shaped slider member is a plate member and a rack is formed on a rim of one of a pair of longer sides of the slider member. The actuation force to the slider member is input into the rack. Longitudinal guiding grooves are formed on the slider member in the longitudinal direction on the central portion of the plate width. By engaging the guiding groove with two guide pins having expanded head portion, the slider member receiving the actuation force performs linear reciprocating movement.

An axis support portion which is formed by bending the slider member at right angle is provided on approximately central portion of the other side of pair of sides of the slider member. That is, the axis portion is attached having a predetermined height relative to a body portion. An arm member connected to a door side is swingably pivoted on the axis portion. In accordance with the reciprocating movement of the slider member, the arm member is swung or retracted relative to the vehicle body to open or close the vehicle door.

With the construction of the known opening and closing mechanism for vehicle opening disclosed in Japanese Patent Application Laid-Open No. 2000-335245, the actuation force generated in the electric motor is transmitted to the slider member via the engagement between series of gears. Thus, in order to reduce the backlash and to prevent the disengagement of gears, each gear has to be arranged in accurate positions and the accurate positioning has to be maintained over a long period of time.

Accordingly, effective opening and closing mechanism could not be constructed due to the complexity for assembling the opening and closing mechanism and the necessity for reinforcing the attaching portion of the gears.

Further, according to the known opening and closing mechanism for vehicle opening disclosed in Japanese Patent Application Laid-Open No. 2000-335245, the rack and the axis portion is positioned offset from each other. In addition, because the axis portion has the predetermined height relative to the body portion of the plane slider member, portions slidably receiving the slider member with two guide pins is deviated from the plane surface including the rack and the axis portion. That is, when reciprocating the slider member, the force to rotate the slider member on the common plane surface of the body of the slider member and the force to lift up the slider member in the external direction of the plane surface are always affecting on the slider member around the guide pin slidably receiving the slider member as a fulcrum point.

Thus, it is necessary to reinforce the attaching structure of the guide pin and to thicken the slider member in order to eradicate the shake of the slider member derived from the above mentioned two kinds of force.

Further, the known opening and closing mechanism for vehicle opening disclosed in Japanese Patent Application Laid-Open No. 2000-335245 shows an example for applying the opening and closing mechanism on a back door which is opened upwardly. In this case, the load applied on the arm member is varied depending on the opening angle of the back door. Also, because a sealing member is provided between the back door and the vehicle body in most of case, for closing the back door completely it is necessary for deforming the sealing member to apply large force at a closing up position.

Notwithstanding, according to the known opening and closing mechanism for vehicle opening disclosed in Japanese Patent Application Laid-Open No. 2000-335245, the actuation force generated by the electric motor is decelerated to increase the torque by a constant ratio by the series of gear members and transmitted to the arm member. Thus, for example, the lack of the actuation force of the electric motor may be caused when the motion of a hinge portion of the back door becomes heavy due to the dust and dirt and the hardening of the sealing member by aging. For overcoming these defects, applying electric motor with larger output capacity is not favorable because of the increase in size and the increase in manufacturing cost.

Another known opening and closing mechanism is disclosed in U.S. Pat. No. 6,142,551. According to the known opening and closing mechanism disclosed in U.S. Pat. No. 6,142,551, the actuation force from an electric motor is transmitted to a slider member via a worm fixed on the electric motor, a worm wheel engaged with the worm, a gear coaxially formed with the worm wheel, and other gears of a gear train.

The long slider corresponds to a plate member and a rim of one of a pair of loner sides thereof is formed with a rack. The actuation force to the slider member is input into the rack from a final gear of the gear train. One end of the slider member is penetrated through inside of a swing case supported coaxially with the final gear. The slider member is held between the final gear and a holding roller in the swing case for reciprocating while swinging in accordance with the rotation of the rack. An approximately arc shaped link member is connected to the slider member. and a vehicle door is connected to the link member. With this construction, the actuation force from the electric motor is transmitted to the vehicle door.

The known opening and closing mechanism disclosed in U.S. Pat. No. 6,142,551 is, for example, installed in a rear ceiling portion of the vehicle. In this case, it is preferable to construct the opening and closing mechanism as small as possible in order to ensure large interior space.

Notwithstanding, in the known opening and closing mechanism disclosed by U.S. Pat. No. 6,142,551, an extending direction of pivotal axis of each gear of a series of gears, an extending direction of connecting axis of the sliding member and the link member, and an extending direction of the pivotal axis of the back door are all positioned parallel to one another. That is, the each gear and a swing plane including the swinging slide member and the link member are all arranged parallel to each other. The back door has a construction to open upward and the swing plane of the back door is extended in perpendicular direction. Thus, the opening and closing mechanism of U.S. Pat. No. 6,142,551 installed on the rear ceiling of the vehicle is projected towards the downward of the interior space. In particular, a gear diameter may be predetermined to be large for increasing the deceleration ratio of the motor in order to open and close the large back door with heavy weight. In that case, the projecting amount of the open and closing mechanism into the interior space is further increased.

A need thus exists for an opening and closing mechanism which effectively and securely transmits the actuation force, operates with large actuation force at open position and closed position, and provide efficient use of an interior space.

SUMMARY OF THE INVENTION

In light of the foregoing, the present invention provides an opening and closing mechanism for a cover for vehicle which includes a crank gear rotatable about a crank axis center for opening and closing the cover for vehicle, a slider reciprocating along a guide member, a crank arm pivoted on a crank pin of the crank gear on one end and pivoted on a slider pin of the slider on the other end, and a cover operation member provided between the slider and the cover for vehicle to be swingable relative to the slider for cooperating the slider and the cover for vehicle.

According to another aspect of the present invention, an opening and closing mechanism for a cover for vehicle includes a crank gear rotatable about a crank axis center for opening and closing the cover for vehicle, a slider reciprocating along a guide member, a crank arm pivoted on a crank pin of the crank gear on one end and pivoted on a slider pin of the slider on the other end, a cover operation member provided between the slider and the cover for vehicle to be swingable relative to the slider for cooperating the slider and the cover for vehicle, a first rotation member rotatable about a first rotational axis center which is parallel to or coaxial to the axis center of the operation member pivotal axis, a first guide surface formed on the guide member for guiding the first rotation member, a second rotation member rotatable about a second rotational axis center which is parallel to or coaxial to an axis center of the slider pin, a second guide surface formed on the guide member for guiding the second rotation member, an operation member pivotal axis for pivoting the cover operation member on the slider, and an output shaft of a drive motor for driving the crank gear, the output shaft positioned on a side opposite to an interior space of the vehicle relative to the crank gear.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

FIG. 1(*b*) is an overview showing an installation of the opening and closing mechanism under open condition according to the first embodiment of the present invention.

FIG. 9(*b*) is an explanatory view showing the operation of the crank mechanism at an intermediate position according to the first embodiment of the present invention.

FIG. 9(*c*) is an explanatory view showing the operation of the crank mechanism at the open position according to the first embodiment of the present invention.

DETAILED DESCRIPTION OF THE INVENTION

Figure 1A:
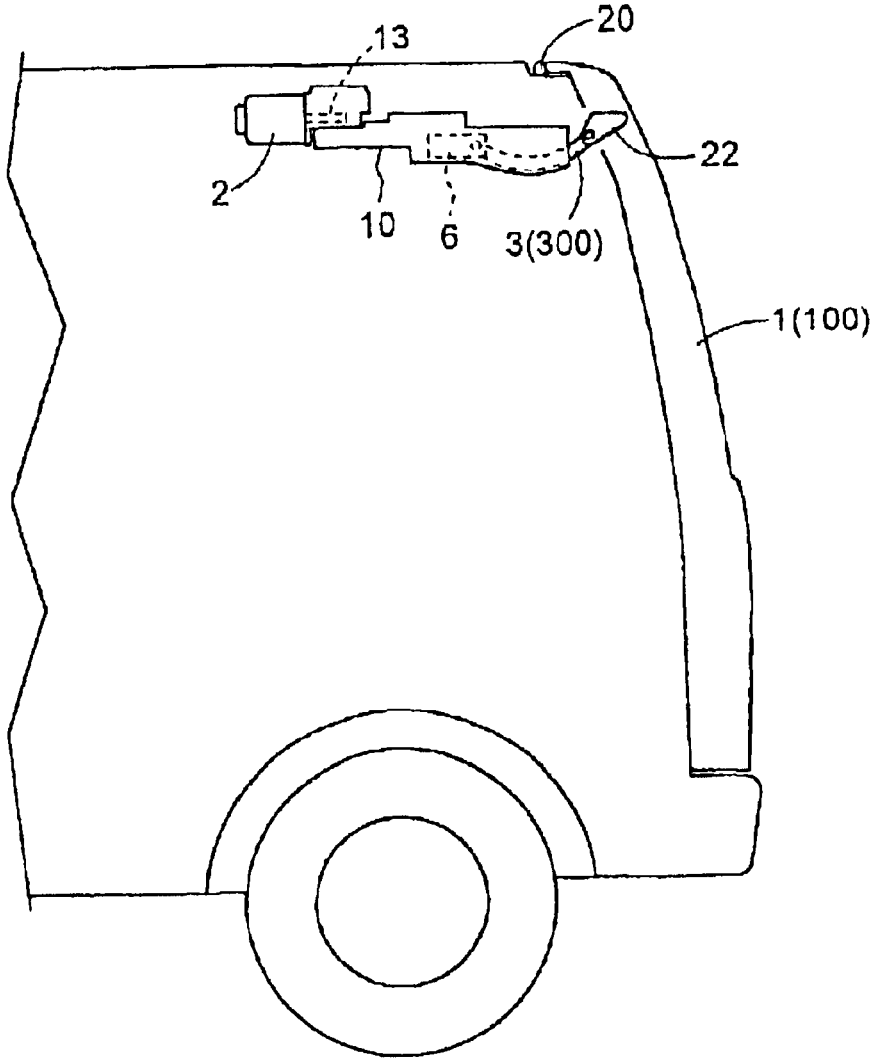
FIG. 1(*a*) is an overview showing an installation of an opening and closing mechanism under closed condition according to a first embodiment of the present invention.

A first embodiment of an opening and closing mechanism will be explained with reference to the illustrations in the drawing figures.

Figure 1B:
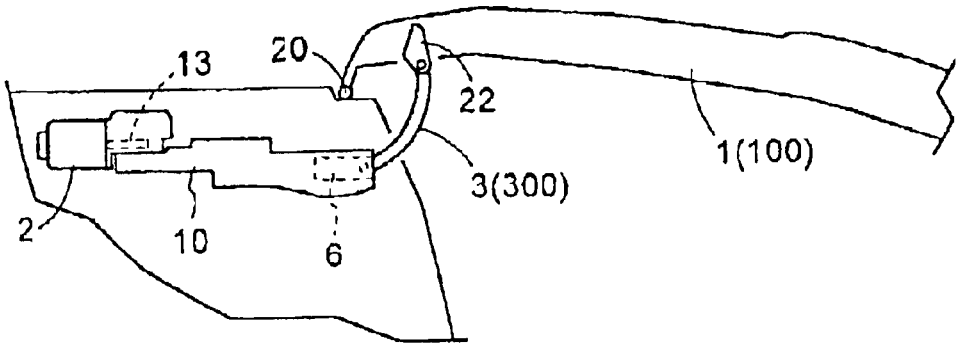

As shown in FIG. 1, the opening and closing mechanism for vehicle opening of the present invention is applied to a portion for operating, for example, a back door 1 (i.e., hereinafter the back door 1 is explained as an illustration of a cover 100) of a one box car between a closed condition (shown in FIG. 1(*a*)) and an open condition (i.e., shown in FIG. 1(*b*)). The operation of the back door 1 is performed by transmitting the actuation force from a drive motor 2 to a cover operation member 300 (i.e., hereinafter explained as a door arm 3) via a crank mechanism. The opening and closing mechanism for vehicle opening of the present invention will be explained based on the embodiment for opening and closing the back door 1.

Figure 2:
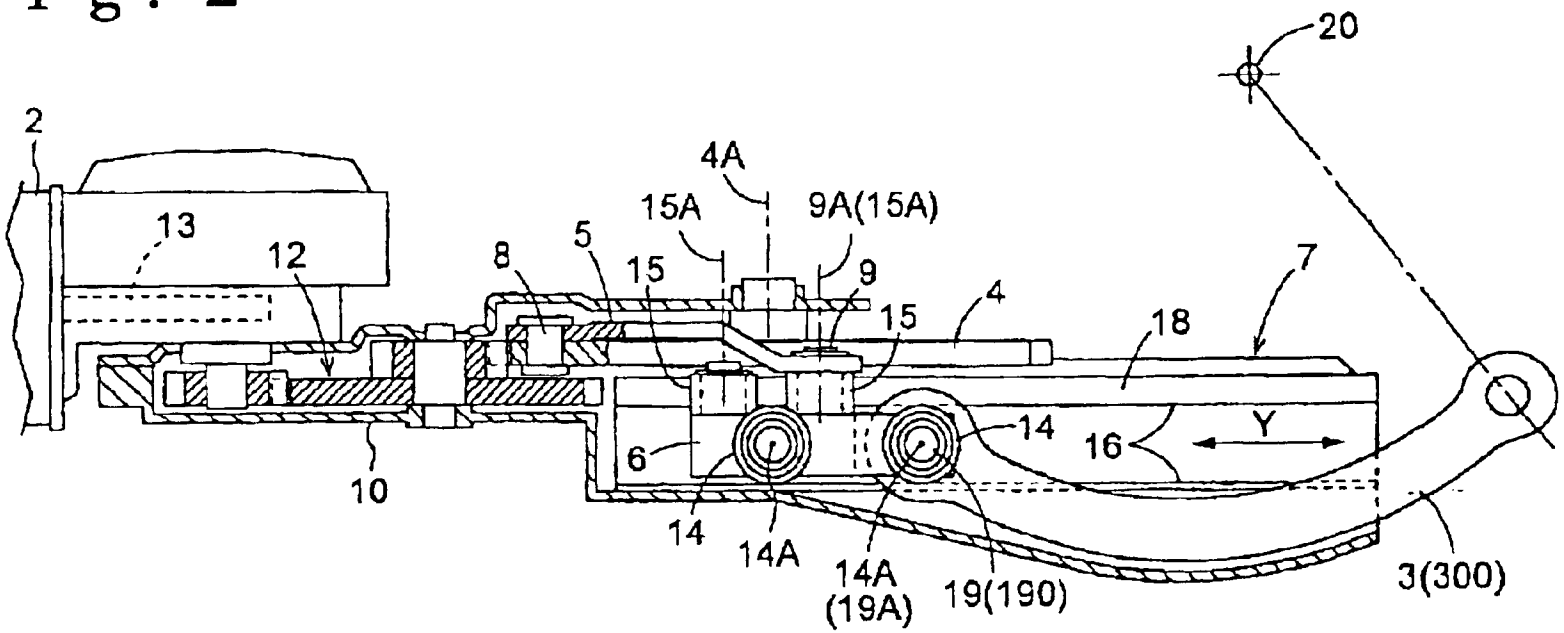
FIG. 2 is a lateral cross-sectional view showing the opening and closing mechanism under fully closed condition according to the first embodiment of the present invention.
Figure 3:
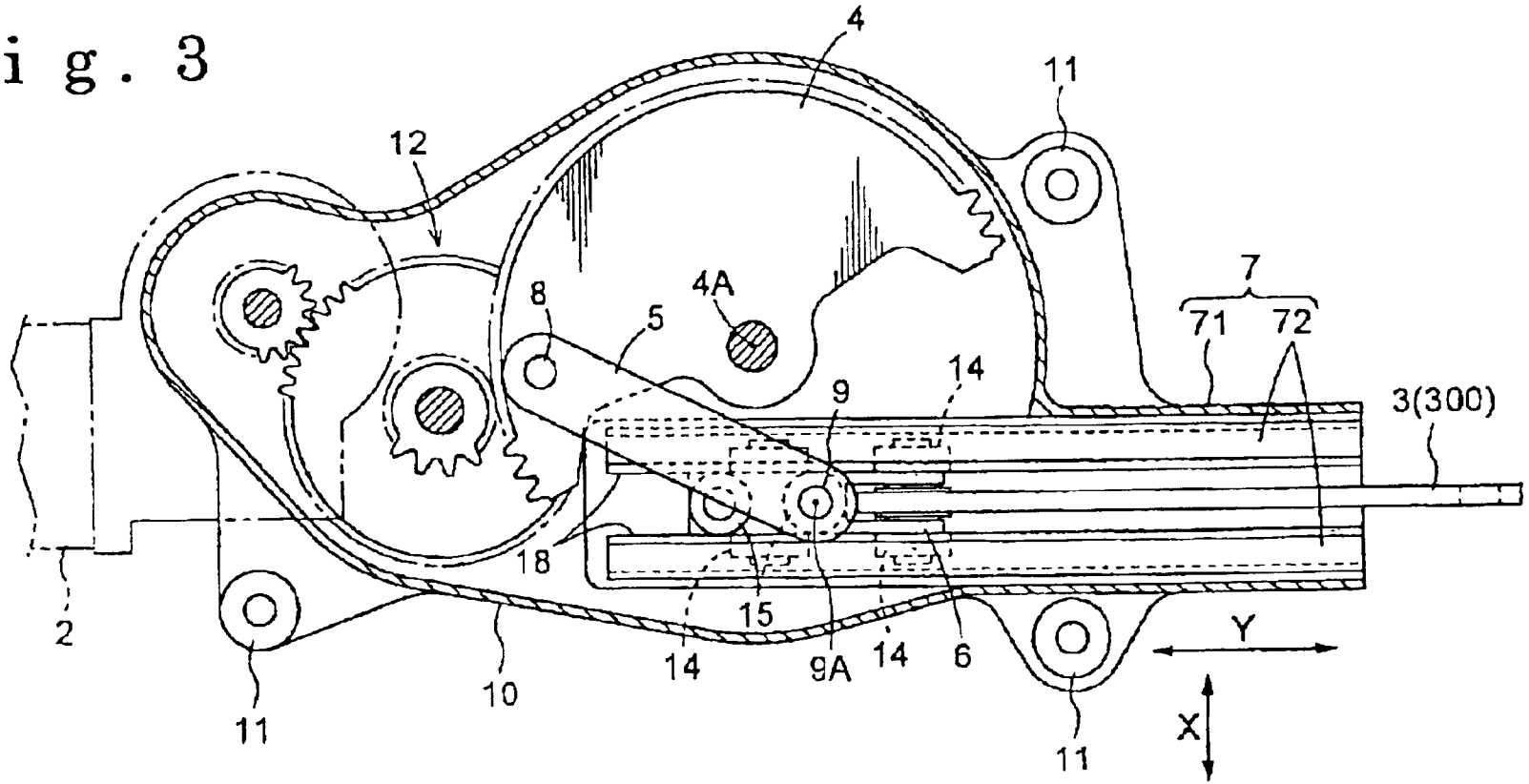
FIG. 3 is a plane cross-sectional view showing the opening and closing mechanism under approximately closed condition according to the first embodiment of the present invention.

As shown in FIGS. 2–3, the opening and closing mechanism for vehicle opening includes a crank gear 4, the drive motor 2 for actuating the crank gear 4, a crank arm 5 connected to the crank gear 4, a slider 6, the door arm 3 connected to the slider 6 for providing the opening and closing force to the back door 1, and a guide member 7 for guiding the slider 6.

The crank gear 4 and the crank arm 5 are connected via, for example, a crank pin 8. The crank arm 5 and the slider 6 are connected via, for example, a slider pin 9. Thus, compared to a mechanism in which the force is transmitted via gears, the connection between each member is firmly kept and the transmission of the force between each member can be securely performed. With this construction of the opening and closing mechanism of the first embodiment, the actuation force from the crank gear 4 can be securely transmitted to the slider 6 via the crank arm 5. Thus, the back door having a predetermined weight can be securely opened and closed and safe opening and closing mechanism can be constructed without a drawback that the back door 1 at the open position is suddenly closed.

With the application of the crank mechanism, the drive stroke and the actuation force of the slider 6 can be optimized by properly determining the position of the crank pin 8, a position of the guide member 7, and a length of the crank arm 5, even when the drive capacity of the drive motor 2 and the size of the crank gear 4 are constant. Thus, because the desired opening and closing mechanism can be obtained by changing the configuration of relatively simply configured member and by changing the relative position of the members, the opening and closing mechanism of the first embodiment of the present invention is applicable to various doors with different designs depending on types and models of vehicles.

The opening and closing mechanism is formed as one unit to be easily installed in the ceiling portion of the vehicle. The members constructing the opening and closing mechanism are assembled to a mechanism body 10 which has an outer shell structure. The mechanism body 10 is constructed having a recess shaped space by aluminum die casing. The crank gear 4 and other members are assembled to be accommodated in the recess shaped space. The mechanism body 10 is installed in the vehicle via mechanism attaching portions 11. As the mechanism attaching portions 11, bolt bores which is insertable with attaching bolts are formed on the mechanism, body 10.

As shown in FIGS. 2–5, the crank gear 4 is rotatably actuated about a crank axis center 4A for opening and closing the back door 1. The crank gear 4 has a diameter necessary for ensuring the stroke of the slider 6. The crank gear 4 is engaged with a plurality of deceleration gear trains 12 for inputting the actuation force from the drive motor 2 to the crank gear 4.

As shown in FIG. 1, the drive motor 2 for opening and closing the back door 1 is provided on an end portion of the opening and closing mechanism. As shown in FIG. 2, an output shaft 13 of the drive motor 2 is positioned on the side opposite to the interior space of the vehicle relative to the crank gear 4. Thus, when the opening and closing mechanism is installed in the rear ceiling portion of the vehicle, the drive motor 2 is positioned closer to the ceiling relative to the crank gear 4 to ensure larger interior space.

Figure 5:
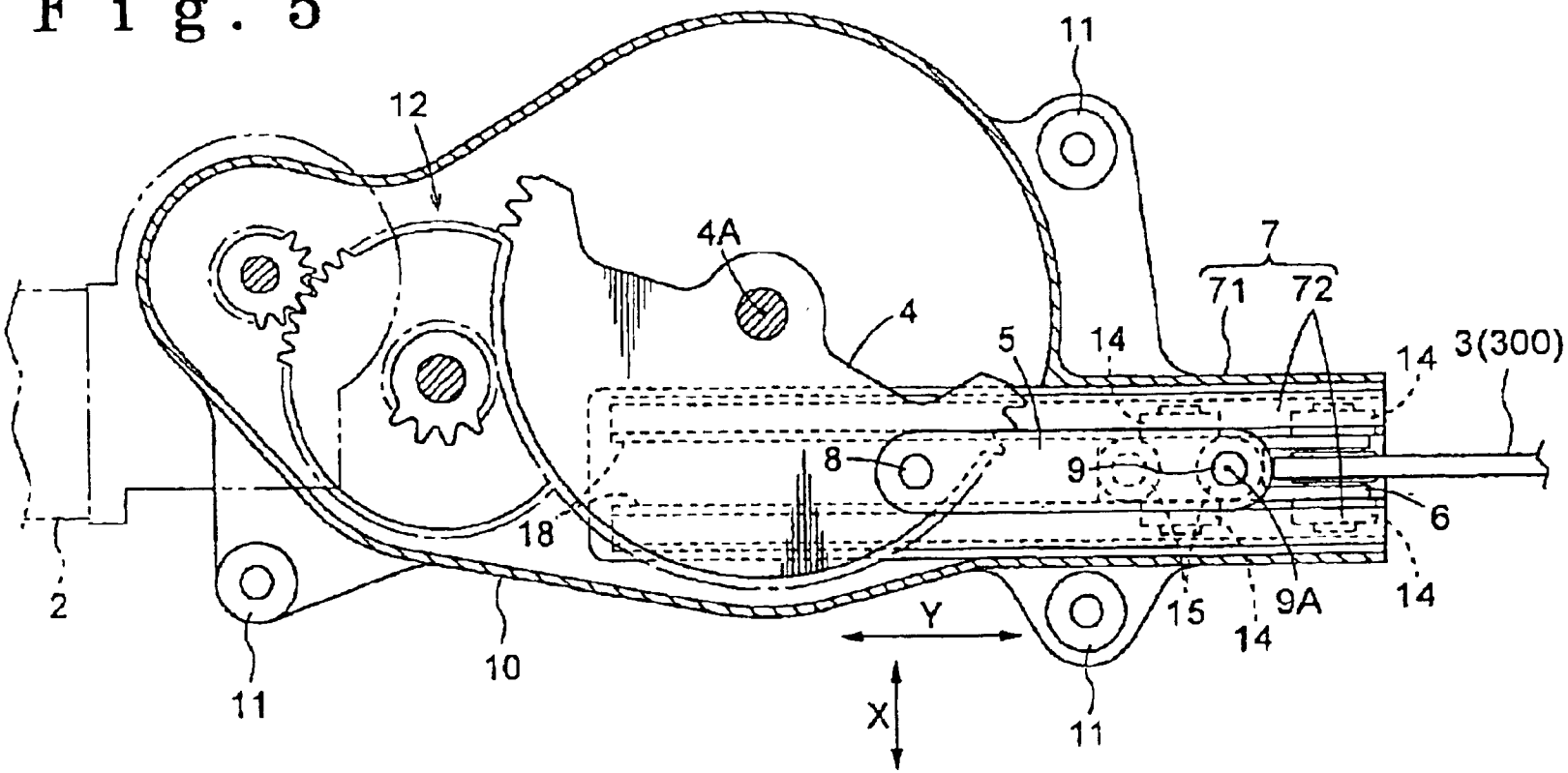
FIG. 5 is a plane cross-sectional view showing the opening and closing mechanism under approximately open condition according to the first embodiment of the present invention.

As shown in FIGS. 3 and 5, one end of the crank arm 5 is pivoted on the crank pin 8 of the crank gear 4. The other end of the crank arm 5 is pivoted on the slider pin 9 of the slider 6. The length of the crank arm 5 is properly determined in accordance with a diameter of the crank gear 4 and a distance between the guide member 7 and the crank axis center 4A. For example, if the length of the crank arm 5 is elongated, swing angle of the crank arm 5 is decreased, the change of the relative angle between the crank arm 5 and the slider 6 is decreased, and the crank arm 5 can smoothly transmits the actuation force to the slider 6. Notwithstanding, the longer the crank arm 5 is, the larger the size of the opening and closing mechanism becomes. On the other hand, if the length of the crank arm 5 is shortened, the opening and closing mechanism per se can be miniaturized. However, in this case, the swing angle of the crank arm 5 is increased to deteriorate the efficiency for transmitting the actuation force to the slider 6.

As shown in FIGS. 2–5, the slider 6 reciprocates along the guide member 7. The slider 6 is provided between the crank arm 5 and the door arm 3 for cooperating the crank arm 5 and the door arm 3 while changing the transmitting direction of the actuation force. The slider pin 9 is provided in the central portion of a width direction X on the slider 6. Wherein, the width direction X is defined as to be corresponding to a direction perpendicular to a moving direction Y of the slider 6 on a common plane surface (i.e., right, left direction of FIG. 3) with the moving direction Y.

Figure 6:
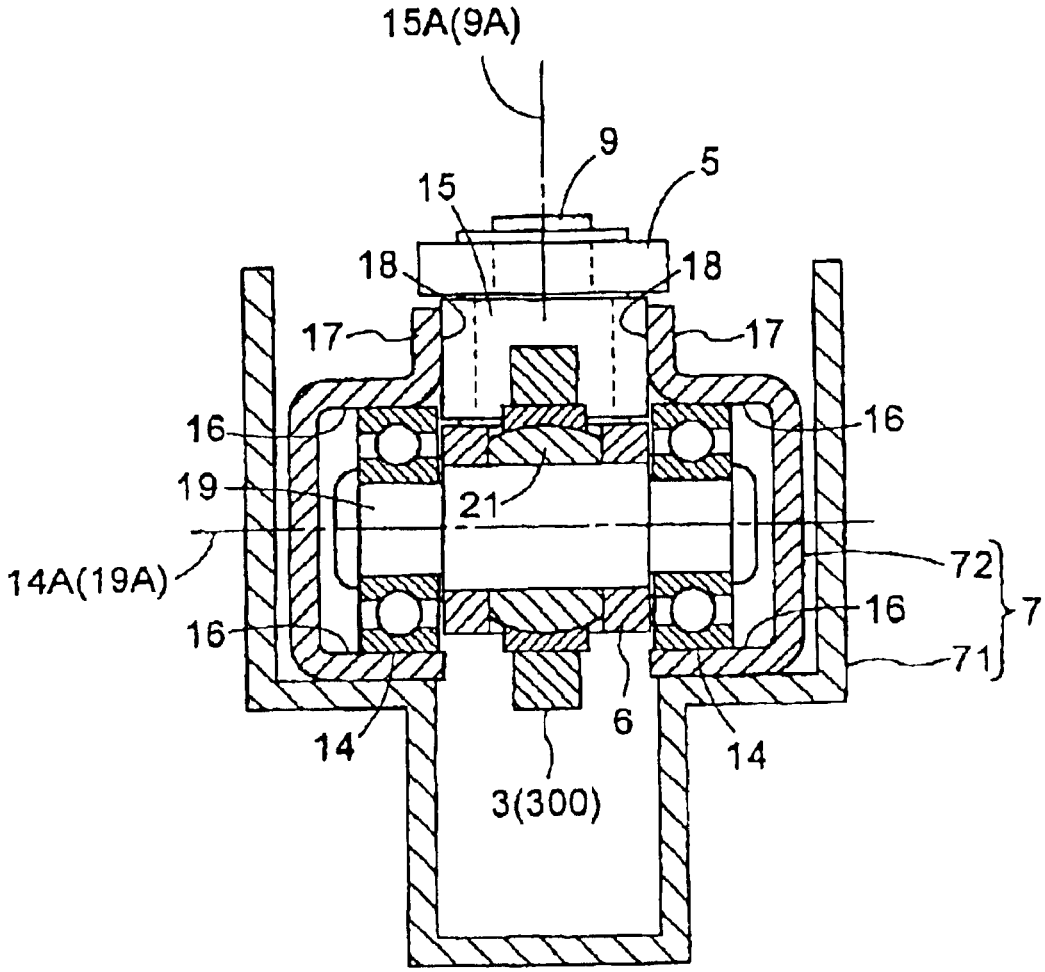
FIG. 6 is a cross-sectional view of a slider and a guide member according to the first embodiment of the present invention.
Figure 8:
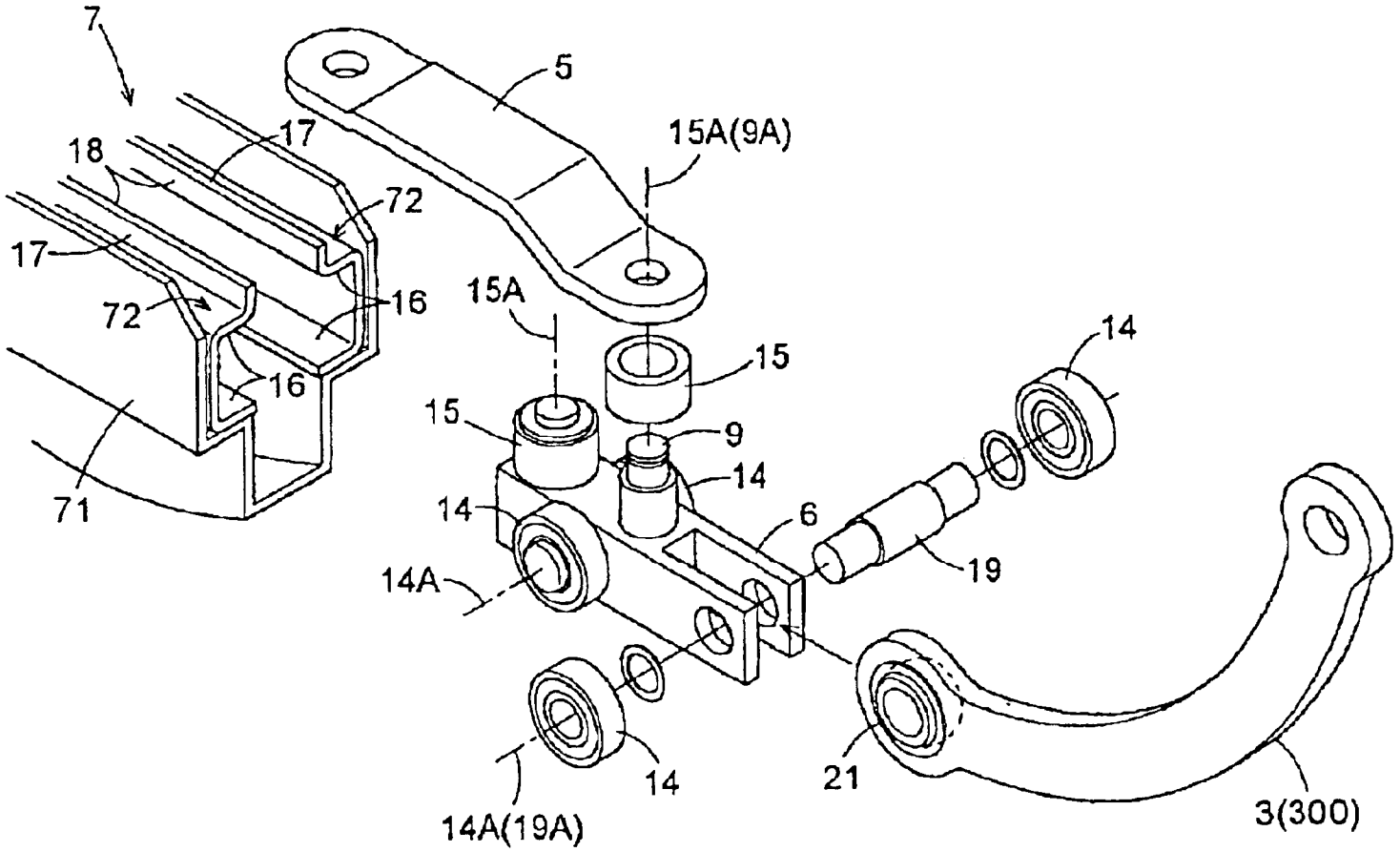
FIG. 8 is an exploded perspective view showing a construction around the slider according to the first embodiment of the present invention.

As shown in FIGS. 6 and 8, the slider 6 is provided with first rotation members 14 and second rotation members 15 which are for smoothly guiding the reciprocating movement of the slider 6. The first rotation members 14 are rotatable about first rotational axis centers 14A extended in the perpendicular direction relative to the slider pin 9 when viewing along the moving direction Y of the slider 6. The first rotational axis center 14A is perpendicular to the moving direction Y of the slider 6 on the common plane surface (i.e., extended in right, left direction of FIG. 6).

As shown in FIGS. 2 and 8, two first rotational axis centers 14A are provided on the slider 6 along the moving direction Y and two pairs of the first rotation members 14 are assembled to the first rotational axis center 14A respectively sandwiching the slider 6. The first rotation members 14 are mainly for corresponding to the input from the door arm 3 which is transmitted while consecutively changing the direction. The function of the first rotation members 14 will be explained hereinafter.

As shown in FIG. 6, radial bearings may be applied as the first rotation members 14. Cylindrical rotatable collar members may be applied as the first rotation members 14. In other words, the member with any construction is to be applied as the first rotation members 14 as long as reducing the frictional force between the guide member 7 and the slider 6 and performing the reciprocating movement of the slider 6 along the guide member 7. Non-rotatable projection members provided on the slider 6 may be substitutable for the first rotation members 14 as long as guiding the slider 6 along the guide member 7.

As shown in FIGS. 2–6, the slider 6 is provided with two second rotational axis centers 15A. The second rotation members 15 are rotatable about the second rotational axis centers 15A respectively. One of the second rotational axis centers 15A corresponds to an axis center 9A of the slider pin 9. That is, in the first embodiment of the opening and closing mechanism, the slider pin 9 functions as the attaching portion of one of the second rotation members 15. The second rotation members 15 is mainly for corresponding to the input from the crank arm 5 transmitted while changing the direction and for guiding the slider 6.

Likewise the first rotation members 14, radial bearings, rotatable cylindrical members, and slidable projection member are applicable to the second rotation members 15.

Figure 4:
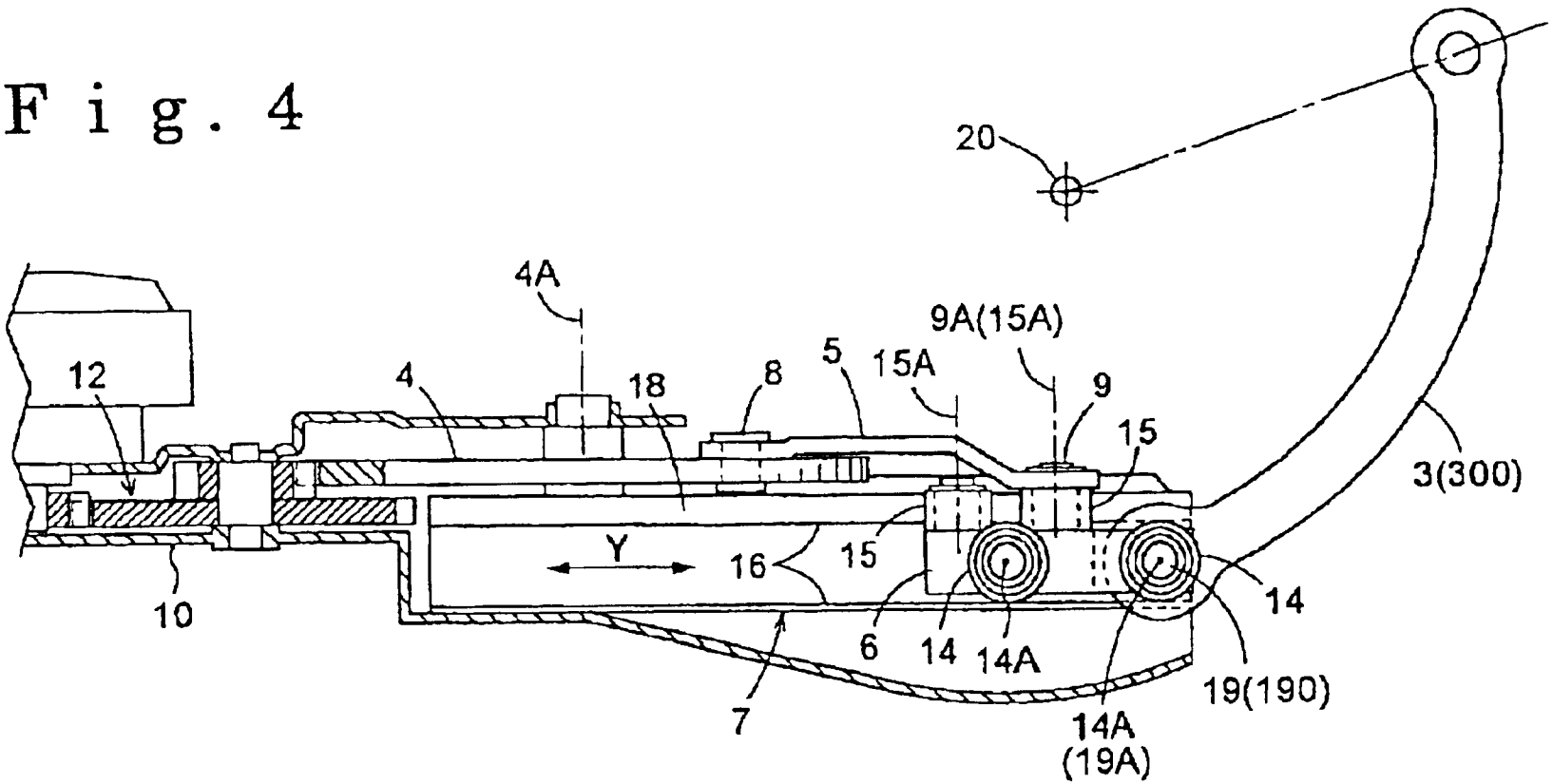
FIG. 4 is a lateral cross-sectional view showing the opening and closing mechanism under fully open condition according to the first embodiment of the present invention.

The guide member 7 is for restricting the moving direction of the slider 6. As shown in FIGS. 4 and 6, the guide member 7 includes a guide body 71 and a rail member 72.

In the first embodiment of the opening and closing mechanism of the present invention, the guide body 71 is integratedly formed with the mechanism body 10. For example, a groove portion is formed by aluminum die casing and the rail member 72 is assembled to the groove portion.

With this construction, it is not necessary to separately provide the guide body 71 and the thickness of the member corresponding to the guide body 71 is reduced, thus the size of the opening and closing mechanism as a whole is reduced. In addition, elimination of the guide body 71 has economical advantage.

The rail member 72 is, for example, constructed with two approximately U shaped long members. In this case, as shown in FIG. 6, first guide surfaces 16 are formed on an internal upper hem and internal bottom hem of the U shaped portion of the rail member 72 respectively. Second guide surfaces 18 are formed on a flange portion 17 adjacent to a rim portion of the upper hem portion of the U-shaped portion. The rail member 72 can be assembled to the guide body 71, for example, using screw member.

As shown in FIG. 6, because the first guide surfaces 16 and the second guide surfaces 18 are formed on the rail member 72, the guild remember 7 can be formed in compact size. Thus, the size of the opening and closing mechanism can be reduced. The rail member 72 can be formed by, for example, bending the plate long member. Thus, it has economical advantage that the time for manufacturing the rail member 72 is reduced.

When the back door 1 is opened and closed, the relative angle between the door arm 3 and the slider 6 is consecutively changed to change the transmission angle of the force between the door arm 3 and the slider 6. Thus, the force from the direction different from the reciprocating movement direction of the slider 6 affects the slider 6. For example, provided that FIG. 4 shows the condition that the back door 1 is started to be closed. When starting closing the back door 1 from the fully open condition, the door arm 3 is extended upward relative to the moving direction Y of the slider 6. Thus, when the slider 6 operates to retract the door arm 3, the slider 6 is pulled upward by the door arm 3. In this case, by receiving the first rotation members 14 by the first guide surfaces 16, the rise of the slider 6 can be prevented even when the force in the upward direction is generated and the friction between the slider 6 and the rail member 72 can be controlled to be the minimum. Thus, smooth operation for starting closing of the back door 1 is achieved.

On the other hand, provided that FIG. 4 shows the condition that the back door 1 is about to be the open position from the closed position. In this case, the pushing force between the slider 6 and the door arm 3 is generated. Thus, the first rotation members 14 are pushed to the first guide surfaces 16 formed on the bottom hem. However, even in this case, the slider 6 can be smoothly operated by cooperating the first rotation members 14 and the first guide surfaces 16. As foregoing, with the construction for guiding the first rotation members 14 with the first guide surfaces 16, the excessive play of the slider 6 can be prevented and the smooth movement of the slider 6 can be achieved irrespective of the position of the door arm 3 relative to the slider 6 and irrespective of application of either the push or pull force between the slider 6 and the door arm 3.

According to the first embodiment, the axis center 19A of the door arm shaft 19 (i.e., shown as an illustration of an operation member pivotal axis 190) for pivoting the door arm 3 on the slider 6 corresponds to one of the first rotational axis center 14A. With this construction, compared to the case for separately constructing axis center 19A and the first rotational axis center 14A, the slider 6 can be constructed compact in size and the size of the opening and closing mechanism as a whole can be reduced. In addition, the manufacturing process time for slider 6 can be reduced.

With the construction of the opening and closing mechanism of the first embodiment, accompanying with the rotation of the crank gear 4, the crank arm 5 swings relative to the slider 6. That is, the transmitting direction of the force is consecutively changed between the crank arm 5 and the slider 6 in the swing plane surface. Therefore, the slider 6 should be supported not to be rotated in the rail member 72 by resisting against the force from the crank arm 5.

In light of the foregoing, the slider 6 is provided with the second rotation members 15 rotating about second rotational axis centers 15A which is parallel to the axis center 9A of the slider pin 9 and the second guide surfaces 18 for guiding the second rotational members 15 are formed on the rail member 72 constructing the guide member 7.

Thus, by receiving the second rotation members 15 by the second guide surfaces 18, the slider rail 6 is supported in the rail member 72 without interefance. Accordingly, the smooth movement of the slider 6 and the back door, 1 can be achieved by restraining the generation of the excessive resistance between the slider 6 and the rail member 72.

As foregoing, the door arm 3 is provided between the slider 6 and the back door 1 for cooperating the slider 6 and the back door 1. As shown in FIGS. 1–2, the back door 1 is assembled to a hinge 20 provided on a rear top portion of the vehicle. Thus, the door arm 3 swings on the common plane surface perpendicular to the hinge 20 and the door arm shaft 19 in accordance with the reciprocating movement of the slider 6.

In the first embodiment, the axis center 19A of the door arm axis 19 is positioned approximately perpendicular to the crank axis center 4A. When the opening and closing mechanism of the first embodiment of the present invention is installed in the ceiling portion of the rear portion of the vehicle and the back door 1 is opened upward, the door arm 3 swings upward and downward. The axis center 19A of the door arm axis 19 is approximately horizontally positioned and the crank axis center 4A of the crankshaft 4 is positioned approximately perpendicular direction. As foregoing, the crank gear 4 has a relatively large diameter for ensuring the stroke of the slider 6. Thus, by arranging the crank gear 4 in the horizontal position, the plate surface of the crank gear 4 can follow along the ceiling to ensure the large internal space of the vehicle.

Figure 7:
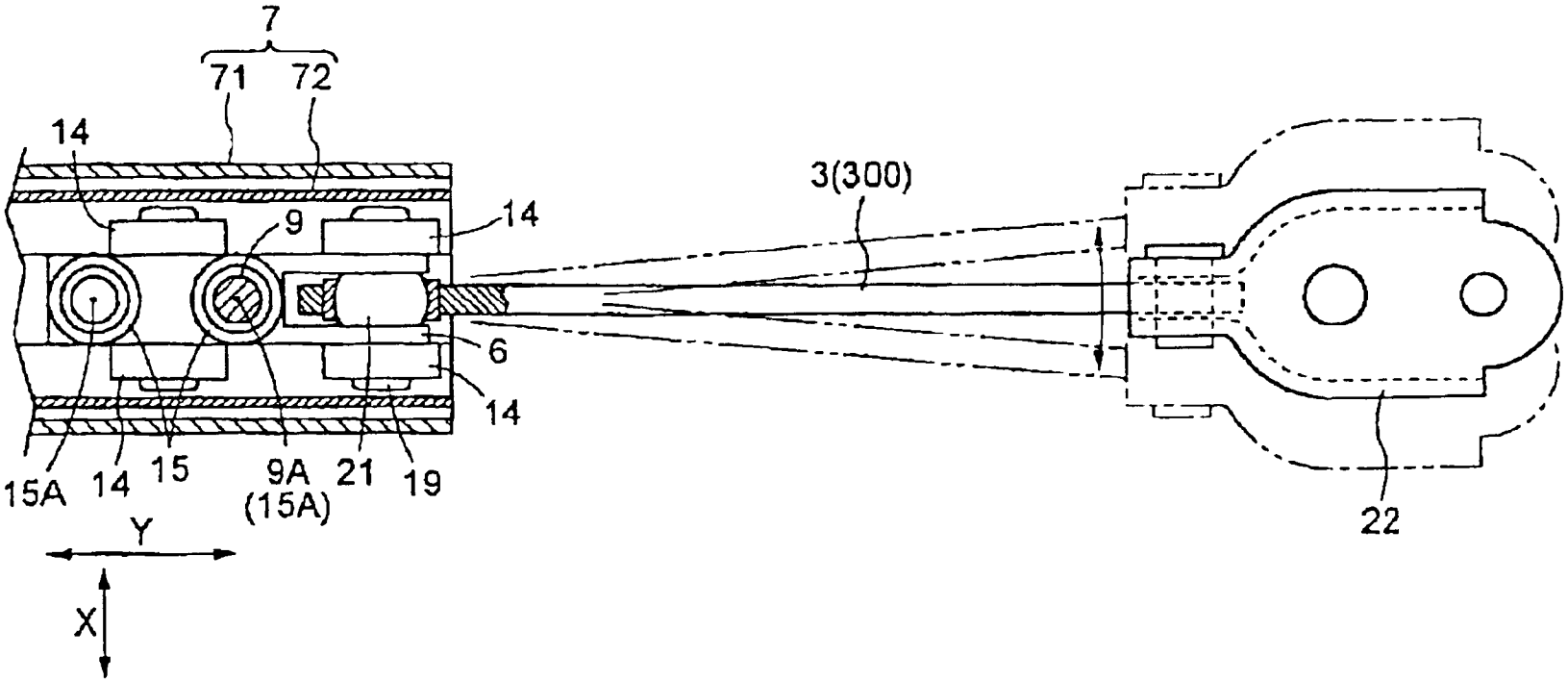
FIG. 7 is an explanatory view showing an operation of a partially spherical joint according to the first embodiment of the present invention.

According to the opening and closing mechanism of the first embodiment of the present invention, the back door 1 can be smoothly opened and closed even when installation position does not match exactly in the width direction of the vehicle when installing the back door 1. As shown in FIG. 7, one end of the door arm 3 is pivoted on the door arm shaft 19 via a spherical joint 21. An attaching member to the back door 1 is provided on the other end of the door arm 3.

In some case of the installed condition of the back door 1, the door arm 3 may not be exactly extended in perpendicular direction relative to the door arm shaft 19. Even in this case, however, by providing the spherical joint 21, the smooth swing operation of the door arm 3 relative to the door arm shaft 19 deviating from the perpendicular line of the door arm shaft 19 and the door arm 3 is allowed. Thus, the affection of the unreasonable force affecting the door arm 3 and the door arm shaft 19 is prevented to smoothly open and close the back door 1.

Figure 9A:
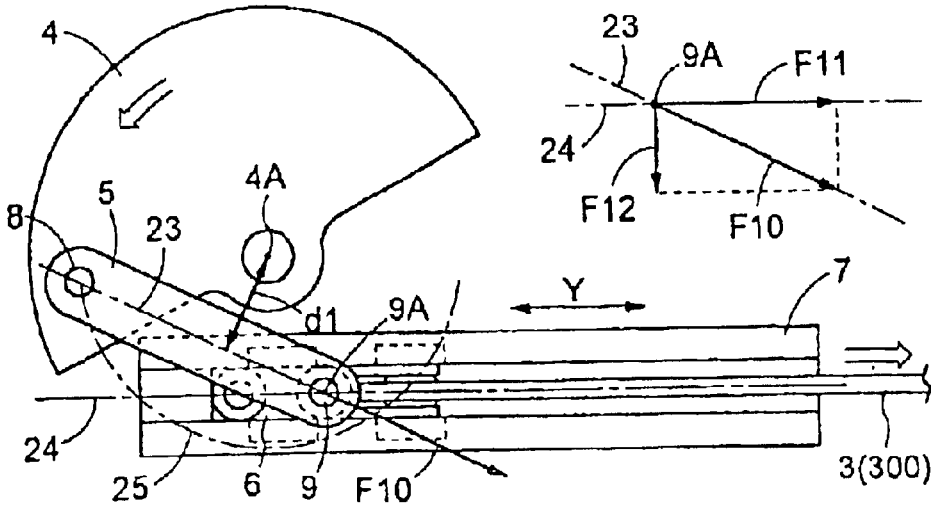
FIG. 9(*a*) is an explanatory view showing-the operation of a crank mechanism at the closed position according to the first embodiment of the present invention.
Figure 9B:
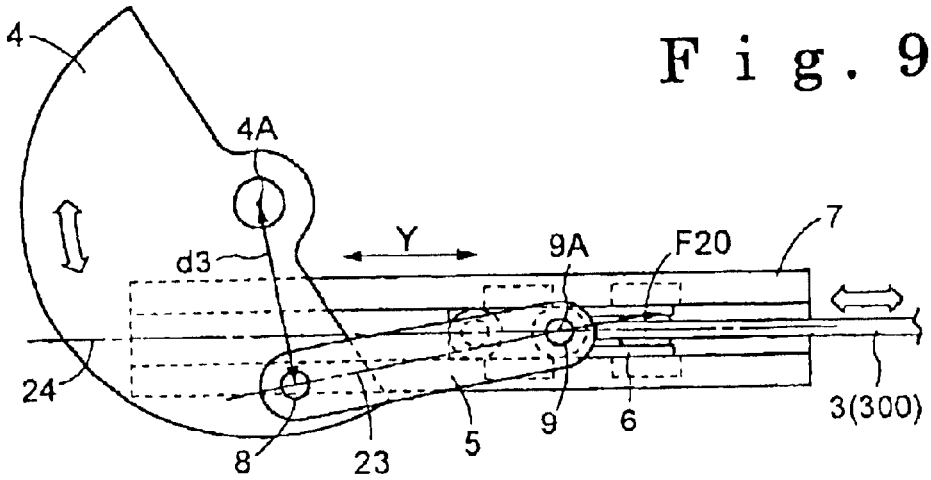
Figure 9C:
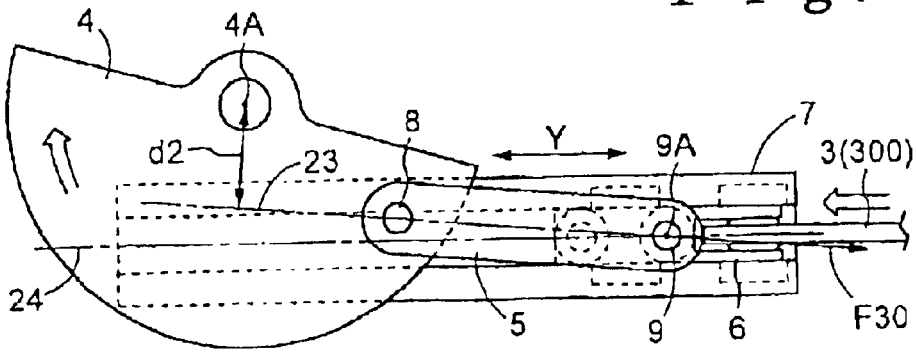

As shown in FIGS. 2–5, when opening and-closing the back door 1, the crank gear 4 is reciprocatingly rotated between the closed position and the open position. In accordance with the reciprocating rotation of the crank gear 4, as shown in FIG. 9, the position and the direction of an arm center line 23 and an extended line connecting the crank pin 8 and the slider pin 9 are varied. The length of the vertical line from the crank axis center 4A to the arm center line 23 is varied, and thus, the actuation force applied from the crank gear 4 to the crank arm 5 and from the crank arm 5 to the slider 6 is varies.

FIG. 9(*a*) shows the crank gear 4 under the closed position. FIG. 9(*c*) shows the crank gear 4 under the open position. FIG. 9(*b*) shows the crank gear 4 under intermediate position between the closed positioned and the open position. As shown in FIGS. 9(*a*)–9(*c*), with the construction of the opening and closing mechanism of the first embodiment, a vertical line length d3, which is longer than a closed position vertical line length d1 at the closed position of the crank gear 4 and an open position vertical line length d2 at the open position of the crank gear 4, is achieved at the position between the closed position and the open position.

The shorter the length of the vertical line, that is, the shorter the moment arm from the crank axis center 4A is, the more the actuation force transmitted from the crank gear 4 to the crank arm 5 is increased. For example, relatively large actuation force F10 and F30 affects along the longitudinal direction of the crank arm 5 in FIGS. 9(*a*) and 9(*c*). To the contrary, actuation force F20 is smaller than the actuation force F10 and F30.

Generally, when closing the back door 1 of the one box car, large force is required for starting closing and for closing to the fully closed position. The back door 1 is provided with a gas damper for supporting the weight of the open back door 1. Thus, large operational force is required due to the application of the operational resistant force of the gas damper at start of closing operation. Further, in case the dirt and dust are accumulated in the hinge portion of the back door during the long-term usage to cause the stiff movement of the hinge portion, further greater operational force is required. At the fully closed position, large operational force is necessary for closing against the elastic resistance of a sealing member provided between the back door 1 and the vehicle body. In case the sealing member is hardening by aging, operational force required for achieving fully closed condition is increased.

On the other hand, in general, when operating the back door 1 under the closed position to be opened, large operational force is required at start of opening. This is because it is required to give an opening speed to the back door 1 against the inertia of the back door 1 on the start of opening the back door 1 from the closed position.

With the opening and closing mechanism of the first embodiment of the present invention, both opening force and closing force on the start of opening and the start of closing can be increased. Thus, the opening and closing force at the closed position and the open position can be properly determined without applying the motor with large actuation force capacity. Further, increasing degree of the actuation force at closed position and at open position can be arbitrary determined by devising the size of the crank gear 4 and positioning of the rail member 72 relative to the crank gear 4.

As shown in FIG. 9, relative angle between the direction of the crank arm 5 and the moving direction Y of the slider 6 is not constant during the operation of the slider 6. Thus, for example, as shown in FIG. 9(*a*), an actuation force F10 transmitted from the crank arm 5 to the slider 6 is resolved into a component force F11 along the moving direction Y of the slider 6 and a component force F12 which is vertical to the component force F11. The component force F12 generates a resistant force to the movement of the slider 6. Thus, in order to effectively transmit the actuation force of the crank arm 5 to the slider 6 by reducing the resistant force, it is preferable to approximate the longitudinal direction of the crank arm 5 to the moving direction of the slider 6 for reducing the force F 12.

In light of the foregoing, viewing along the extended direction of the crank axis center 4A as shown in FIG. 9, the guide member 7 is positioned so that a reciprocation locus 24 of the slider pin 9 and the extended line thereof are intersecting a rotational locus 25 of the crank pin 8. The opening and closing mechanism is constructed so that the position of the crank pin 8 at the closed position (i.e., FIG. 9(*a*)) and the open position (FIG. 9(*c*)) are positioned on the crank axis center 4A side relative to the reciprocation locus 24 and the extended line thereof.

With this construction, for example, when the crank gear 4 is rotated from the closed position to the intermediate position, the crank pin 8 traverses the reciprocation locus 24 and the crank pin 8 traverses the reciprocation locus 24 again when the crank gear 4 is moved from the intermediate position to the open position. With this construction, the crank arm 5 and the reciprocation locus 24 of the slider pin 9 correspond each other twice, thus, the crank arm 5 performs reciprocating swing movement relative to the reciprocation locus 24.

Accordingly, by positioning the slider 6 and the crank arm 5 in the foregoing manner to approximate the direction of the crank arm 5 and the moving direction of the slider 6 as much as possible, the generation of the excessive component force can be reduced to the minimum and the actuation force from the crank arm 5 can be the most effectively transmitted to the slider 6.

With the construction of the opening and closing mechanism of the first embodiment, the slider pin 9 is formed in the central portion of the with direction X of the slider 6 and the door arm 3 is assembled to approximately the central portion of the door arm shaft 19 assembled to the slider 6. That is, the door arm 3 swings on the common plane surface approximately perpendicular to the door arm shaft 19 and the moving route of the slider 6 and the slider pin 9 are included on the common plane surface.

By positioning the slider pin 9 and the attaching portion of the door arm 3 not to be offset each other in the moving direction of the slider 6, the actuation force once inputted into the forwarding direction of the slider 6 can be effectively transmitted to the door arm 3. In other words, by avoiding the offset condition between the slider pin 9 and the door arm 3, the generation of the force for self-rotating the slider 6 is prevented.

When observing the transmission of the force in FIG. 9, the interference of the slider 6 to the guide member 7 is prevented and the force affecting from the slider 6 to the guide member 7 is limited to the component force F12 generated when transmitting the force from the crank arm 5 to the slider 6. Thus, the actuation force form the crank gear 4 can be effectively transmitted to the back door 1 to the maximum.

A second embodiment of an opening and closing mechanism of the present invention will be explained as follows. Although two long members having U-shape in cross section is used for constructing the rail members 72 of the first embodiment, the rail members 72 may be constructed using four long members having rectangular shape in cross-section.

Figure 10:
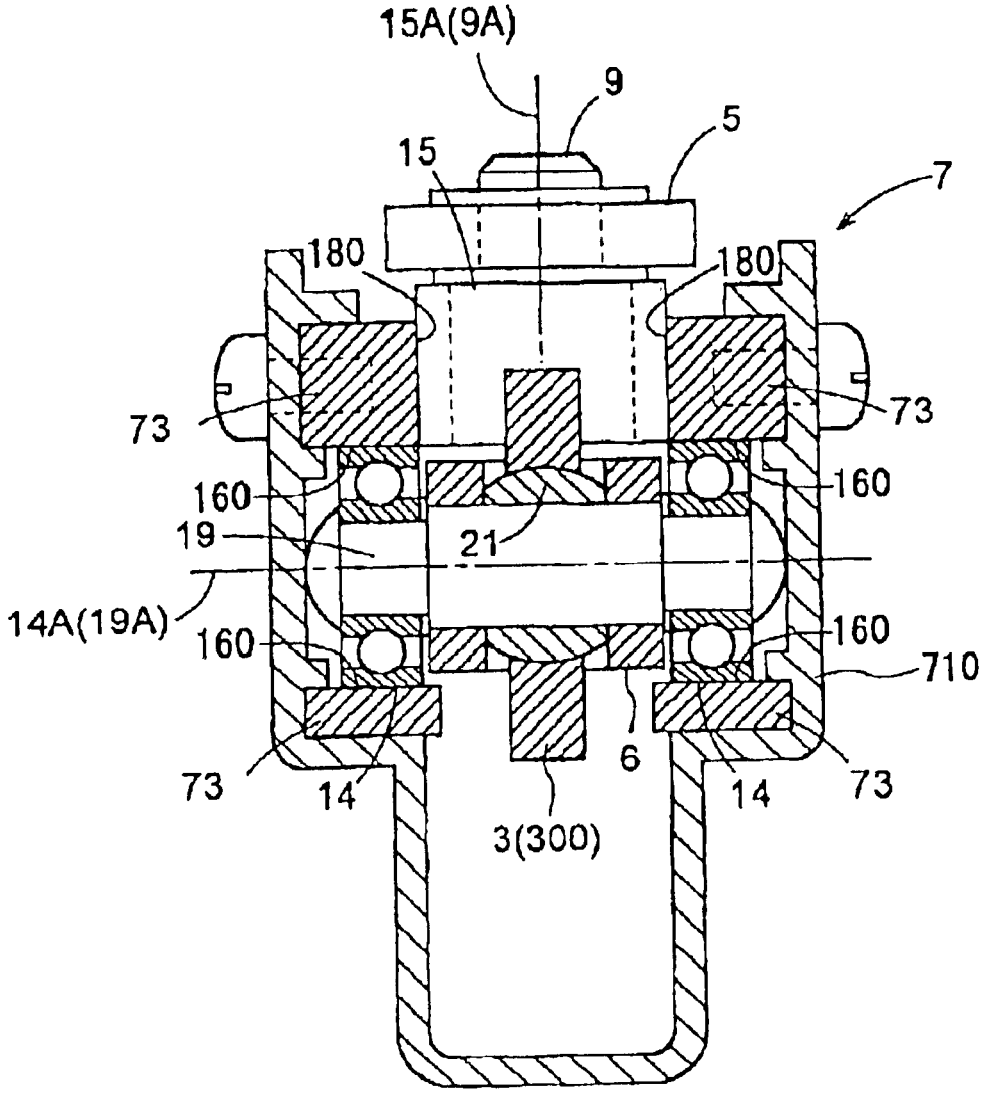
FIG. 10 is a cross sectional view showing a slider and a guide member according to a second embodiment of the present invention.

According to the second embodiment of the opening and closing mechanism of the present invention, as shown in FIG. 10, four rail members 73 having rectangular cross-section are applied. Viewing from the cross-section perpendicular to the longitudinal direction of a guide body 710, four rail members 73 are positioned in four corners. The rail members 73 may be fixed with screws relative to the guide body 710 or may be fitted thereto. Thus, cross-shaped space is formed in the guide body 710. As shown in FIG. 10, the slider 6, the first rotation members 14, and the second rotation members 15 are positioned in a cross-shaped space.

First guide surfaces 160 for guiding the first rotation member 14 are formed respectively. Two rail members 73 of the four rail members 73 are formed with second guide surfaces 180 for guiding the second rotation members 15. That is, two rail members 73 positioned for sandwiching the slider pin 9 are formed with both the first guide surfaces 160 and the second guide surfaces 180 respectively.

By providing plural functions such as the first guide surface 160 and the second guide surface 180 on the common rail member 73, the number of the composing parts of the rail members 73 can be reduced to simplify the construction and thus the compact construction of the guide member as a whole can be achieved.

With the construction including four individual rail members 73, a position adjustment function (not shown) for determining the relative position of each rail member 73 can be provided, thus to easily obtain the guide member 7 without the shakiness.

In addition, the rail members 72 of the first embodiment and the rail members 73 of the second embodiment may be constructed with a single member. Two rail members 72 of the first embodiment shown in FIG. 6 may be connected on the opposite side of the flange portions 17. In that case, in order to ensue the swing space of the door arm 3, an expanding portion is provided on the opposite side to the flange portions 17. With this construction, the number of the composing parts of the rail members can be reduced and the manufacturing time for assembling to the guide body 710 can be reduced, thus to more effectively obtain the opening and closing mechanism.

According to the present invention, by adopting the crank mechanism to the opening and closing mechanism of the cover for vehicle, the actuation force of the crankshaft can be securely transmitted to the slider via the crank arm. The crank gear and the crank arm are connected via the crank pin. On the other hand, the crank arm and the slider are connected via the slider pin. Thus, the connection between each member is unlikely intercepted and the transmission of the force between each member can be securely performed.

Because the crank gear is applied to the driveline, the optimum drive mechanism can be constructed in accordance with the weight of the door for opening and closing and the drive capacity of the drive motor by properly determining the forming position of the crank pin even if the size of the crank gear is constant. Thus, the number of the necessary parts can be reduced for designing various opening and closing mechanisms.

The crank mechanism is applied to the opening and closing mechanism of the present invention. In order to perform the effective transmission of the actuation force, for example, it is necessary to achieve the smooth movement of the slider relative to the guide member. According to the opening and closing mechanism of the present invention, after the direction of the actuation force from the crank gear is converted into the forwarding direction of the slider, the rotation of the slider about the slider pin by the actuation force with converted direction is prevented.

With the construction of the opening and closing mechanism of the present invention, one end of the cover operation member and the slider pin are positioned on the identical plane vertical to the axis center of the operation member pivotal axis. That is, the cover operation member swings in the common plane surface perpendicular to the operation member pivotal axis and the moving route of the slider and the slider pin are included on that common plane surface.

With the foregoing construction, the slider does not rotates when the actuation force after converting the direction affects the slider pin to be transmitted to the cover operational member. Thus, the slider is not unnecessary interfered by the guide member and the actuation force after converting the direction can be effectively transmitted to the cover operation member.

With the opening and closing mechanism of the present invention, the cover operation member swings relative to the slider in accordance with the reciprocating movement of the slider. That is, the transmitting direction of the force is consecutively varied between the cover operational member and the slider in the swing plane surface. Thus, for example, when the slider retracts the cover operation member, the slider may be pulled upward or pulled downward depending on the swing position of the cover operation member.

However, with the construction of the opening and closing mechanism of the present invention in which the slider includes the first rotation members rotating about the first rotation axis centers which is parallel to the axis center of the operational member pivotal axis, by forming the first guide surfaces for guiding the first rotation members on the guide member, the shakiness of the slider is prevented and the friction between the slider and the guide member can be reduced to the minimum to perform the smooth opening and closing operation of the cover for vehicle.

With the opening and closing mechanism of the present invention, the crank arm swings relative to the slider in accordance with the rotation of the crank gear. That is, the transmitting direction of the force is consecutively varied between the crank arm and the slider in this swing plane surface. Therefore, the slider should be supported not to be rotated in the rail member by resisting against the force from the crank arm.

Thus, by providing the second rotational members rotating about the second rotation axis centers which are parallel to the axis center of the slider pin to the slider, and by forming the second guide surfaces for guiding the second rotation member to the guide member, then the interference between the slider and he guide member is prevented and the generation of the excessive resistance can be restrained. Thus, the movement of the slider and the cover for vehicle can be smoothly performed.

The cover for vehicle is installed on the end portion side of the cover operation member. Notwithstanding, the installation of the cover for vehicle is not always accurate. For example, the installation deviation happens in the position of the cover operation member relative to the cover for vehicle. In that case, the cover operation member does not extend perpendicularly to the operation member pivotal axis.

With the construction for pivoting one end of the cover operation member on the operation member pivotal axis via the spherical joint of the present invention, the swing movement deviating from the perpendicular line of the cover operation member relative to the operation member pivotal axis is allowed. Thus, the unreasonable force affecting the cover operation member and the operation member pivotal axis can be prevented even if the installation deviation happens in the cover for vehicle, and the smooth opening and closing operation of the cover for vehicle is achieved.

In the opening and closing mechanism, the length of vertical line from the crank axis center to the arm center line connecting the crank pin and the slider pin or the extended line thereof between the closed position and the open position is longer than the length of the vertical line from the crank axis center to the arm centerline at the closed position and the length of the vertical line from the crank axis center to the arm centerline. The shorter the length of the vertical line from the crank axis center to the arm centerline is, the shorter the moment arm from the crank axis center becomes. And thus, the actuation force transmitted from the crank gear to the crank arm is increased at the closed position and at the open position. Accordingly, the opening and closing force at the closed positioned the open position can be properly determined without applying the motor with large actuation force, the door operation can be performed securely, and the opening and closing mechanism with compact in size and the low manufacturing cost can be achieved. Further, because the crank mechanism is applied to the opening and closing mechanism of the present invention, by devising the size of the crank gear and positioning of the rail member relative to the crank gear, the increasing degree of the actuation force at the closed position and the open position can be arbitrary determined.

The actuation force transmitted from the crank arm to the slider is resolved into the force along the moving direction of the slider and the force perpendicular to thereof at the position of the slider pin. The component force in the perpendicular direction functions as the resistance relative to the movement of the slider. Thus, by reducing the resistance for effectively transmitting the actuation force of the crank arm to the slider, it is preferable to approximate the longitudinal direction of the crank arm to the moving direction of the slider.

By intersecting the reciprocation locus or the extended line thereof of the slider pin and the rotation locus of the crank pin and by positioning the crank pin at the open position the closed position to be positioned on the crank axis center side relative to the reciprocation locus, for example, the crankpin once traverses the reciprocation locus of the slider pin when the crank gear rotates from the closed position to the intermediate position and the crankpin traverses the reciprocation locus of the slider pin again when the crank pin moves from the intermediate position to reach the open position. With this construction, the reciprocation locus of the crank arm and the reciprocation locus of the slider pin correspond twice. And the crank arm performs the reciprocating swing movement relative to the reciprocation locus of the slider pin. Thus, by approximating the direction of the crank arm and the moving direction of the slider, the generation of the force in the direction different from the moving direction of the slider can be reduced to the minimum to perform the most effective transmission of the actuation force from the crank arm to the slider.

The crank mechanism is applied to the opening and closing mechanism of the present invention. In order to ensure the stroke of the slider, the crank gear is constructed to be relatively large. By determining the axis center of the operation member pivotal axis and the crank axis center approximately perpendicular to each other, for example, the following advantage can be obtained when supporting the cover for vehicle which opens upward. That is, when installing the opening and closing mechanism to the rear ceiling of the vehicle, the installing position of the opening and closing mechanism can be determined so that the cover operation member swings on the common plane surface extended in the perpendicular direction. In this case, the longitudinal direction of the crank axis center is arranged in the perpendicular direction. Thus, the plate surface of the crank gear having large diameter follows along the ceiling of the vehicle. Accordingly, the projecting amount of the opening and closing mechanism to the interior space side is reduced and the spacious interior space of the vehicle can be ensured. The "approximately perpendicular" corresponds to the substantially perpendicular condition which includes not accurately perpendicular condition due to the manufacturing error.

By providing the first guide surfaces and the second guide surfaces on the rail member, the size of the rail member can be reduced and the size of the opening and closing mechanism as a whole can be reduced. This expands the interior space of the vehicle. With the opening and closing mechanism of the present invention, because the slider includes the first rotation members rotating about the first rotation axis centers which is parallel to the axis center of the operation member pivotal axis and the second rotation members rotating about the second rotational axis centers which is parallel to the axis center of the slider pin and the first rotational members, and the second rotation members are guided with the first guide surfaces and the second guide surfaces corresponding to the plane surfaces which face different directions, the smooth movement of the slider can be achieved.

By positioning the output shaft of the drive motor on the side opposite to the interior space relative to the crank gear, the drive motor can be positioned closer to the ceiling relative to the crank gear when installing the opening and closing mechanism of the present invention to the rear ceiling of the vehicle. This ensures the further larger interior space. This is advantageous, for example, in the case that the ceiling portion of the rear portion of the vehicle includes inclines in the forward direction and for positioning the drive motor further upward.

With the construction of the opening and closing mechanism of the present invention, by integrally forming the guide body and the mechanism body as one unit, it is not necessary to additionally provide the guide body, and the thickness necessary for separate guide body can be reduced. This reduces the size of the opening and closing mechanism.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An opening and closing mechanism for a cover of a vehicle opening comprising:

a crank gear rotatable about a crank axis center;

a slider reciprocating along a guide member;

a crank arm pivoted on the crank gear at one end and pivoted on the slider at the other end, the crank arm being pivoted on the crank gear about a pivot axis that is positionally fixed relative to the crank gear during all reciprocating movement of the slider; and a cover operation member provided between the slider and the cover so as to be swingable relative to the slider.

2. An opening and closing mechanism for a cover of a vehicle opening according to claim 1, wherein the cover operation member is pivoted on an operation member pivotal axis of the slider by a slider pin, and one end of the cover operation member and the slider pin are positioned on a common plane surface which is perpendicular to an axis center of the operation member pivotal axis.

3. An opening and closing mechanism for a cover of a vehicle opening according to claim 2 further comprising:

a first rotation member being rotatable about a first rotational axis center which is parallel to or coaxial to the axis center of the operation member pivotal axis; and a first guide surface formed on the guide member for guiding the first rotation member.

4. An opening and closing mechanism for a cover of a vehicle opening according to claim 3 wherein one end of the cover operation member is pivoted on the operation member pivotal axis via a partially spherical joint.

5. An opening and closing mechanism for a cover of a vehicle opening according to claim 2 further comprising:

a second rotation member rotatable about a second rotational axis center which is parallel to or coaxial to an axis center of the slider pin; and a second guide surface formed on the guide member for guiding the second rotation member.

6. An opening and closing mechanism for a cover of a vehicle opening according to claim 5 wherein one end of the cover operation member is pivoted on the operation member pivotal axis via a partially spherical joint.

7. An opening and closing mechanism for a cover of a vehicle opening according to claim 2 wherein one end of the cover operation member is pivoted on the operation member pivotal axis via a partially spherical joint.

8. An opening and closing mechanism for a cover of a vehicle opening according to claim 1, wherein the crank arm is pivoted on the crank gear at a crank pin and is pivoted on the slider at a slider pin, a length of a vertical line from the crank axis center relative to an arm center line connecting the crank pin and the slider pin, including an extension so the arm center line, at a position between an open position and a closed position of the cover corresponds to a length of an intermediate position vertical line which is longer than a length of an open position vertical line at the open position and a length of a closed position vertical line at the closed position when the crank gear reciprocates between the open position and the closed position.

9. An opening and closing mechanism for a cover of a vehicle opening according to claim 8, wherein a reciprocation locus of the slider pin and an extended line thereof intersects a rotation locus of the crank pin and the crank pin is positioned on a side of the crank axis center relative to the reciprocation locus and the extended line thereof at the open position and the closed position of the cover, whereby larger force is generated at the open position and the closed position of the cover.

10. An opening and closing mechanism for a cover of a vehicle opening according to claim 1, further comprising:

an operation member pivotal axis for pivoting the cover operation member on the slider; wherein an axis center of the operation member pivotal axis and the crank axis center are positioned perpendicular to each other in a moving direction of the slider.

11. An opening and closing mechanism for a cover of a vehicle opening according to claim 10, wherein the crank arm is pivoted on the slider at a slider pin, and further comprising:

a first rotation member provided on the slider for rotating about a first rotational axis center which is parallel to or coaxial to the axis center of the operation member pivotal axis;

a second rotation member provided on the slider for rotating about a second rotational axis center which is parallel to or coaxial to an axis center of the slider pin;

a rail member included in the guide member;

a first guide surface formed on the rail member for guiding the first rotation member; and a second guide surface formed on the rail member for guiding the second rotation member.

12. An opening and closing mechanism for a cover of a vehicle opening according to claim 11 further comprising an output shaft of a drive motor for driving the crank gear, the output shaft positioned on a side opposite to an interior space of the vehicle relative to the crank gear.

13. An opening and closing mechanism for a cover of a vehicle opening according to claim 12 wherein the guide member includes the rail member and a guide body attached to the rail member and the guide body is integrally formed on a mechanism body attached to the crank gear.

14. An opening and closing mechanism for a cover of a vehicle opening according to claim 11, wherein the rail member includes two long members having U-shape in cross-section.

15. An opening and closing mechanism for a cover of a vehicle opening according to claim 11, wherein the rail member includes four long members having rectangular shape in cross-section.

16. An opening and closing mechanism for a cover of a vehicle opening according to claim 10 further comprising an output shaft of a drive motor for driving the crank gear, the output shaft positioned on a side opposite to an interior space of the vehicle relative to the crank gear.

17. An opening and closing mechanism for a cover of a vehicle opening comprising:

a crank gear rotatable about a crank axis center;

a slider reciprocating along a guide member;

a crank arm pivoted on a crank pin of the crank gear on one end and pivoted on a slider pin of the slider on the other end;

a cover operation member provided between the slider and the cover for a vehicle opening so as to be swingable relative to the slider at an operation member pivotal axis;

a first rotation member rotatable about a first rotational axis center which is parallel to or coaxial to the axis center of the operation member pivotal axis;

a first guide surface formed on the guide member for guiding the first rotation member;

a second rotation member rotatable about a second rotational axis center which is parallel to or coaxial to an axis center of the slider pin;

a second guide surface formed on the guide member for guiding the second rotation member; and an output shaft of a drive motor for driving the crank gear, the output shaft positioned on a side opposite to an interior space of the vehicle relative to the crank gear.

18. An opening and closing mechanism for a cover of a vehicle opening according to claim 17, wherein the cover operation member is pivoted on the operation member pivotal axis of the slider and one end of the cover operation member and the slider pin are positioned on a common plane surface which is perpendicular to an axis center of the operation member pivotal axis.

19. An opening and closing mechanism, for a cover of a vehicle opening according to claim 17, wherein one end of the cover operation member is pivoted on the operation member pivotal axis via a partially spherical joint.

20. An opening and closing mechanism for a cover of a vehicle opening according to claim 17, wherein a length of a vertical line from the crank axis center relative to an arm center line connecting the crank pin and the slider pin or an extended line thereof at a position between an open position and a closed position of the cover corresponds to a length of an intermediate position vertical line which is longer than a length of an open position vertical line at the open position and a length of a closed position vertical line at the closed position when the crank gear reciprocates between the open position and the closed position.

21. An opening and closing mechanism for a cover of a vehicle opening according to claim 17, wherein a reciprocation locus of the slider pin and an extended line thereof intersects a rotation locus of the crank pin and the crank pin is positioned on a side of the crank axis center relative to the reciprocation locus and the extended line thereof at the open position and the closed position of the cover, whereby larger force is generated at the open position and the closed position of the cover.

22. An opening and closing mechanism for a cover of a vehicle opening according to claim 17, wherein the guide member includes the rail member and a guide body attached to the rail member and the guide body is integrally formed on a mechanism body attached to the crank gear.

* * * * *